US007338329B2

(12) United States Patent
Yang

(10) Patent No.: US 7,338,329 B2
(45) Date of Patent: Mar. 4, 2008

(54) POWER CONNECTOR

(75) Inventor: Shi-Zheng Yang, Shanghai (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/390,928

(22) Filed: Mar. 28, 2006

(65) Prior Publication Data

US 2006/0234563 A1 Oct. 19, 2006

(30) Foreign Application Priority Data

Apr. 13, 2005 (CN) ..... 2005 2 0016779 U

(51) Int. Cl.
*H01R 24/00* (2006.01)

(52) U.S. Cl. ..... 439/675; 439/924.1; 439/188; 439/944

(58) Field of Classification Search ..... 439/188, 439/668, 669, 944, 675, 924.1
See application file for complete search history.

(56) References Cited

U.S. PATENT DOCUMENTS 5,927,999 A * 7/1999 Shimojyo ..... 439/63
6,382,999 B1 * 5/2002 Mou et al. ..... 439/188
7,114,989 B2 * 10/2006 Yin ..... 439/578

* cited by examiner

*Primary Examiner*—Tho D. Ta
*Assistant Examiner*—Vanessa Girardi
(74) *Attorney, Agent, or Firm*—Charles S. Cohen

(57) ABSTRACT

A power connector comprising a dielectric housing, having an insertion face and a mounting face. The dielectric housing defining a first mounting passage and a second mounting passage communicating with each other. A first terminal, having a contacting portion inserted into the first mounting passage. A second terminal, having a main body, a first contacting section, a second contacting section, and a first pressing section. The first contacting section is bent from a front end of the main body and extends forwardly, the first pressing section bent from an edge of the main body and extends above the first contacting section. The second contacting section of the second terminal being bent 180 degrees from a rear end of the main body thereof and extending forwardly. The advantages of the present invention are that, the structure of the second contacting section of the second terminal maintains a high force engagement with a mating terminal in a stamped terminal even after multiple and receptacle insertions and withdrawals which is simple, made from a low cost material, occupies a relatively small space, and is manufactured at a low cost.

18 Claims, 5 Drawing Sheets

POWER CONNECTOR

FIELD OF THE INVENTION

The present invention relates to a power connector, and more particularly to a power connector used for a portable electronic device.

BACKGROUND OF THE INVENTION

Electronic devices are provided with power connectors for receiving power from a power supply. A portable electronic device (such as PDA, mobile phone, notebook computer) is further provided with a power connector for charging a battery, or directly supplying power for electronic components in the electronic device.

A prior art power connector as shown in FIG. 1, includes a dielectric housing 40, a first terminal 50, and a second terminal 60. The dielectric housing 40 has an inserting face 41 and a mounting face 42. The dielectric housing 40 defines a first mounting passage 43 and a second mounting passage 44. The inserting face 41 defines an inserting hole 45 which communicates with the first and second mounting passages 43, 44. The mounting face 42 defines a slot 46. The first terminal 50 has a first contacting portion 51 in a cylinder shape, a first connecting portion 52, and a first pressing portion 53. The first connecting portion 52 is bent and extends from one end of the first contacting portion 51. The first pressing portion 53 is bent and extends from the first connecting portion 52 and is located above the first contacting portion 51. The second terminal 60 has a main body 61, a first connecting section 62, a second connecting section 63, a second pressing section 64, a first contacting section 65, and a second contacting section 66. The first connecting section 62 is bent and extends from one end of the main body 61. The second connecting section 63 is bent and extends from the first connecting section 62 and is located above the main body 61. A free cantilevered end of the second connecting section 63 forms the second pressing section 64. The first contacting section 65 extends from the first connecting section 62 and is located above, to one side, and forward of the main body 61. The main body 61 defines an opening 67, a resilient portion extends inclined and upward from one side of the opening 67, and a free end thereof forms the second contacting portion 66.

The second contacting section 66 of the second terminal 60 is stamped and formed from the main body 61 and is only one half the length of the terminal. Because of this short5 length, the resiliency of the second contacting portion 66 will be reduced. A good electrical connection with a good normal force with a conductive contact of a plug connector will be difficult to obtain after many insertions and withdrawals unless a more expensive material is used which can withstand the stress of multiple insertions and withdrawals while not degrading the ability of the terminal to provide a contacting normal force upon the mating terminal. Additionally, the supporting structures of the first contacting section 65, first connecting section 62, the main body 61, and the second contacting section 66 of the second terminal 60 will occupy a relative large space, due to the width of the structure having teeth, The wider terminal will require a wider housing which will not support the low weight and low profile characteristics of modem connectors.

SUMMARY OF THE INVENTION

A main object of the present invention is to provide a power connector, which can maintain a high quality power connection with a high normal force with a mating terminal in a stamped terminal even after multiple plug and receptacle insertions and withdrawals while the structure is simple, made from a low cost material, occupies a relatively small space, and is manufactured at a low cost.

To fulfill the above mentioned object, a power connector of the present invention was developed which is mounted in a portable electronic device and is electrically connected with a conductive contacts of a plug connector. The connector includes a dielectric housing, having an insertion face and a mounting face. The dielectric housing defining a first mounting passage and a second mounting passage communicating with each other. The insertion face including an insertion hole, which communicates with the first and second mounting passages. The mounting face includes slots. A first terminal has a contacting portion inserted into the first mounting passage of the dielectric housing. A second terminal has a main body, a first contacting section and a second contacting section. The first contacting section is bent from a front end of the main body and extends forwardly. The main body, the first contacting section, and the second contacting section are inserted into the second mounting passage of the dielectric housing. The second contacting section of the second terminal is bent from a bottom end of the main body thereof and extends forwardly.

Further, the first terminal has a connecting portion, a contacting portion in a cylinder shape, and a pressing portion. The contacting portion in a cylinder shape is inserted into the first mounting passage of the dielectric housing.

The pressing portion of the first terminal extends from the connecting portion and above the contacting portion, and a free end thereof forms the pressing portion.

The first pressing section of the second terminal extends from the top end of the main body and above the first and second contacting portions. A base portion of the contacting portion of the first terminal forms a retaining portion. A base portion of the first pressing section of the second terminal extends to form a retaining portion.

The main body of the second terminal is punched and formed with a retaining resilient piece, and an opening is defined in a corresponding side wall of the dielectric housing. The retaining resilient piece is latched with the opening.

Free ends of the first contacting section and the second contacting section of the second terminal form horizontal stops, respectively, which are latched into latching slots of the second mounting passage of the dielectric housing, respectively.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

PREFERRED EMBODIMENTS OF THE PRESENT INVENTION

Figure 1:
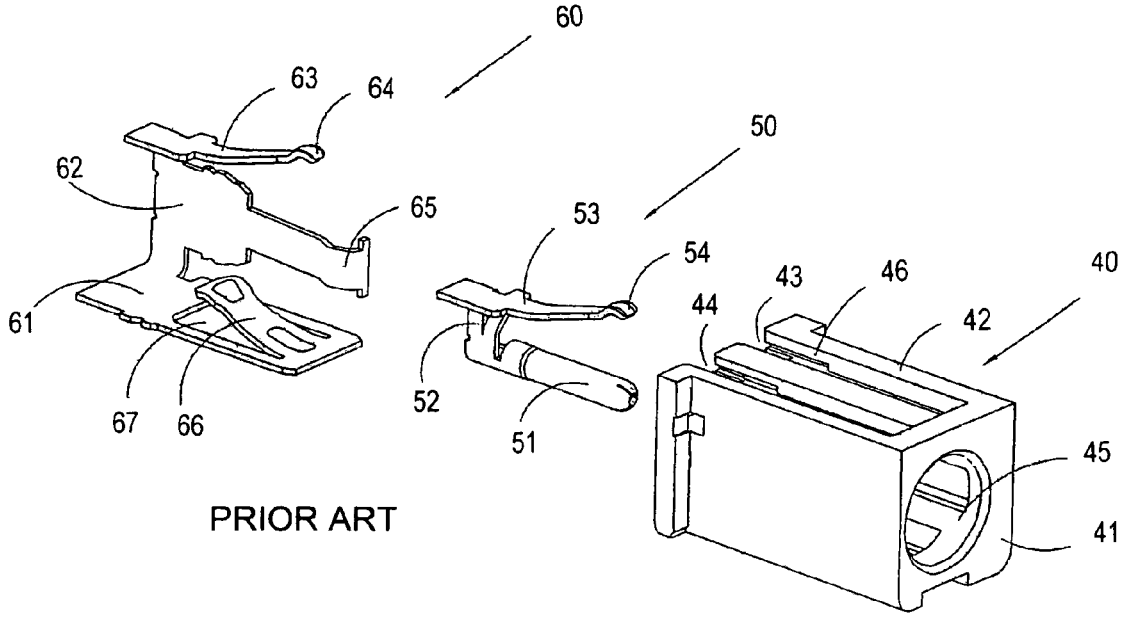
FIG. 1 is an exploded perspective view of a prior art power connector.
Figure 2:
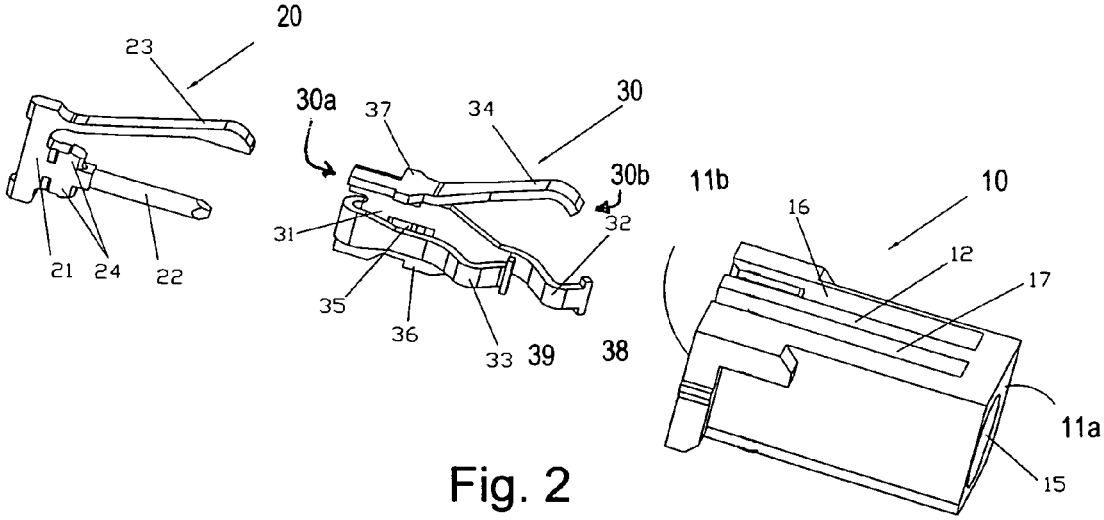
FIG. 2 is an exploded perspective view of the present invention.
Figure 3:
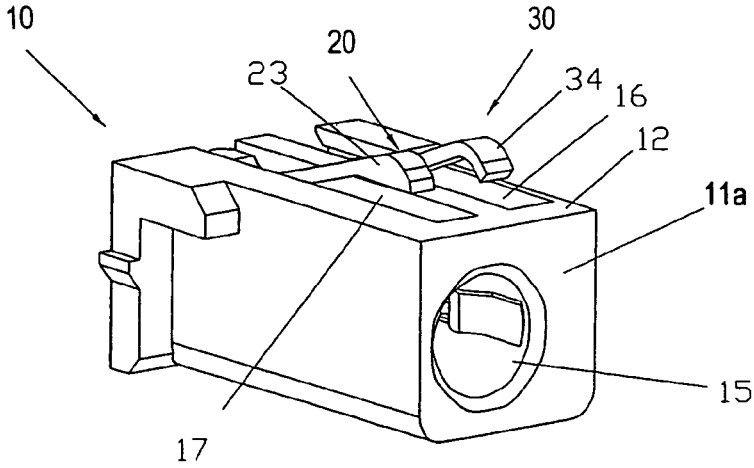
FIG. 3 is a perspective view of the present invention.
Figure 4:
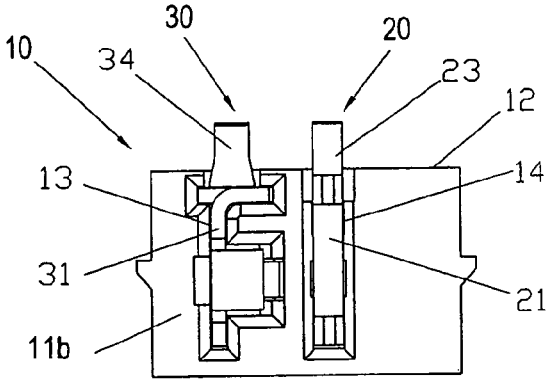
FIG. 4 is a back view of the present invention shown in FIG. 3.
Figure 5:
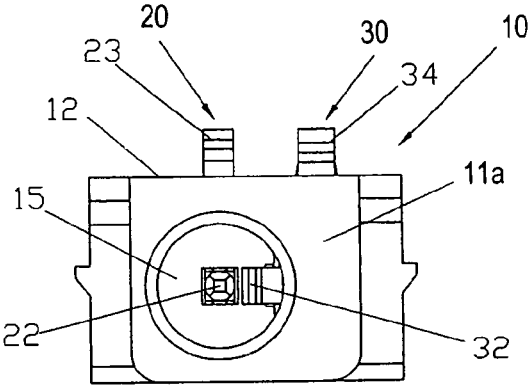
FIG. 5 is a front view of the present invention shown in FIG. 3.
Figure 6:
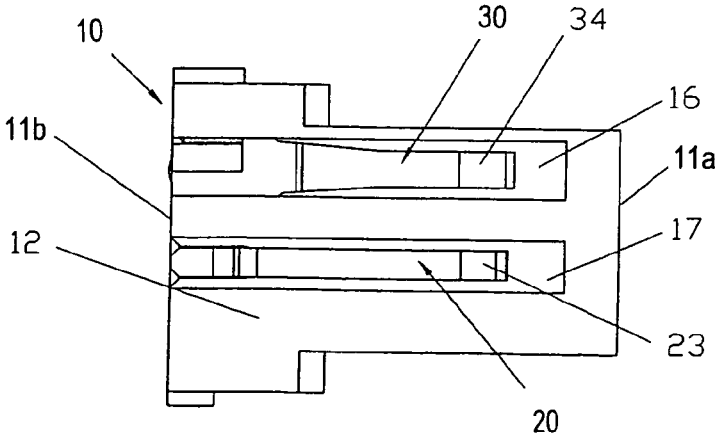
FIG. 6 is a top plan view of the present invention shown in FIG. 3.
Figure 7:
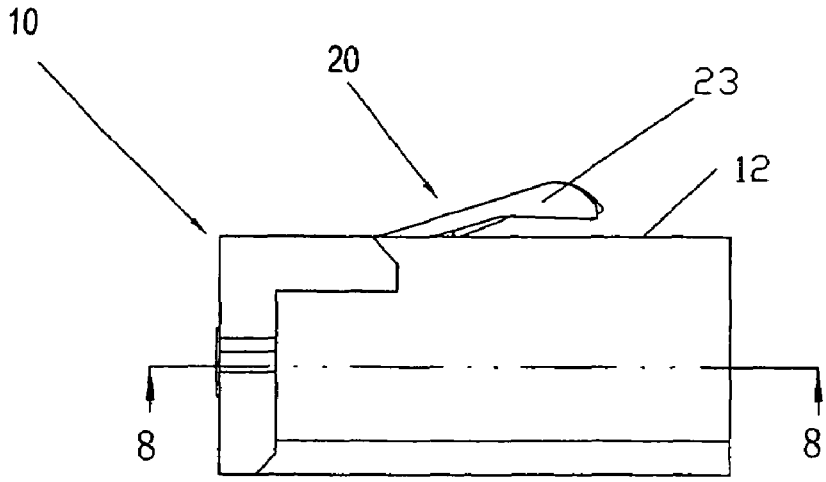
FIG. 7 is a side view of the present invention shown in FIG. 3.

Referring to FIGS. 2 to 8 and FIGS. 9*a* to 9*d*, the preferred embodiment of the present invention is described. The present invention is a power connector to be mounted in a portable electronic device, which is designed to be electrically connected to conductive contacts of a mating plug connector (not shown). The connector includes a dielectric housing 10, having a rectangular shape. A first terminal 20 and a second terminal 30 are arranged in the dielectric housing 10. The dielectric housing 10 has an insertion face 11*a*, an opposite rear end face 11*b*, and a mounting face 12. The dielectric housing 10 includes a first mounting passage 13 and a second mounting passage 14 communicating with each other. The insertion face 11*a* defines an insertion hole 15, communicating with the first and second mounting passages 13, 14 through which the mating plug connector may pass. The mounting face 12 defines recessed slots 16, 17 partially extending from the rear end face 11*b* to the insertion face 11*a*. The slot 16 communicates with the first mounting passage 13 at the rear end face 11*b* thereof.

The first terminal 20 is stamped and formed from a metal sheet material, and is pressed into the first mounting passage 13 from the rear face 11*b* of the dielectric housing 10. The first terminal 20 has a connecting portion 21, a contacting portion 22 in a cylinder shape, and a pressing portion 23. The pressing portion 23 of the first terminal 20 extends above the contacting portion 22 from the connecting portion 21, and is cantilevered. The contacting portion 22 is in a cylinder shape and extends from a retaining portion 24 at a base portion thereof. The retaining portion 24 has an angled tooth structure. The connecting portion 21 and the contacting portion 22 extend into the first mounting passage 13 of the dielectric housing 10 while the teeth of the retaining portion 24 skive into a mounting slot in a side wall of the first mounting passage 13. The pressing portion 23 of the first terminal 20 fits in slot 16 of the mounting face 12 and extends beyond the mounting face 12, to be electrically connected with a circuit board (not shown) to which the dielectric housing 10 is mounted.

The second terminal 30, with a rear end 30*a* and a front end 30*b*, is stamped and formed from a metal sheet material, and is also press fit into the second mounting passage 14 from the rear face 11*b* of the dielectric housing 10. The second terminal has a main body 31, a first contacting section 32, a second contacting section 33, and a first pressing section 34. The main body 31, the first contacting section 32, and the second contacting section 33 are inserted into the second mounting passage 14 of the dielectric housing 10. The first pressing section 34 slides into slot 17 of the mounting face 12 of the dielectric housing 10 and extends beyond the mounting face to be electrically connected with the circuit board (not shown) to which the dielectric housing 10 is mounted. The second contacting section 33 of the second terminal 30 is bent from a rear end of the main body 31 of the second terminal 30 and extends forwardly.

Figure 8:
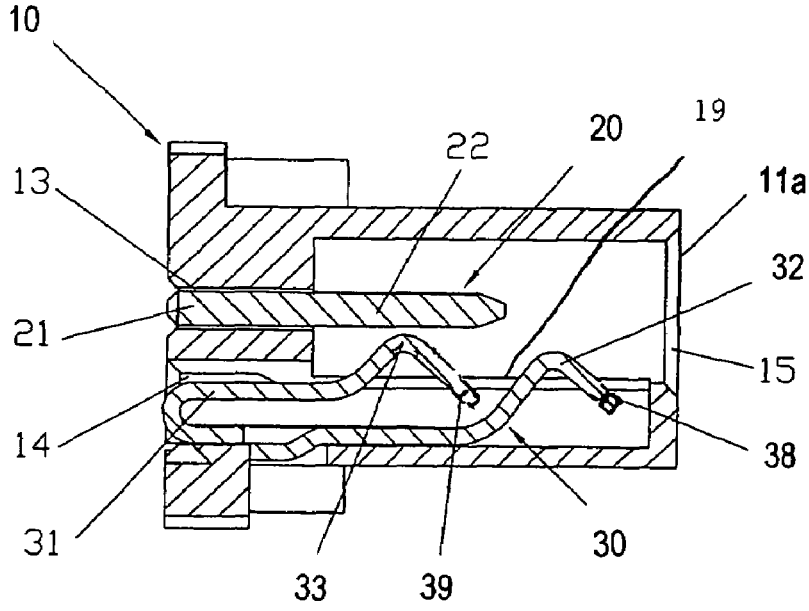
FIG. 8 is a cross sectional view along line 8-8 of FIG. 7.

Referring to FIGS. 9*a* to 9*d*, the first contacting section 32 of the second terminal 30 extends forwardly with a slight bend from a front end of the main body 31. The first pressing section 34 is first bent 90 degrees from a side edge of the main body 31 and then extends forwardly generally above the first contacting section 32. The second contacting section 33 is bent from the rear end of the main body 31 until it extends forwardly in the same direction as the first contacting section 32. The extension length of the first contacting section 32 is longer than the second contacting section 33. As shown in FIG. 8, because of the different extension lengths, the terminals of the mating plug connector (not shown), when inserted into the insertion hole 15 of the inserting face 11*a* of the dielectric housing 10, will first electrically engage with the first contacting section 32 of the second terminal 30, and then electrically engage with the first contacting portion 22 of the first terminal 20 and finally engages the second contacting section 33 of the second terminal 30.

Free ends of the first contacting section 32 and the second contacting section 33 of the second terminal 30 form horizontal stops 38 and 39, respectively, which are held behind a wall 19 in the second mounting passages 14 of the dielectric housing 10. By keeping the sides 38 and 39 behind the wall 19, the first contact section 32 and the second contact section 33 can be pre-loaded allowing a greater force to be placed on the mating plug connector without the force being reduced after many insertions and withdrawals. Base portions of the first pressing section 34 and the main body 31 of the second terminal form relatively narrow retaining sections 37 and 36 respectively. Each retaining section 36, 37 has laterally extending teeth 36*a*, 36*b*, 37*a*, and 37*b* respectively, which are retained in corresponding grooves in side walls of the second mounting passage 14, to fix the second terminal 30 to the dielectric housing 10.

Figure 9A:
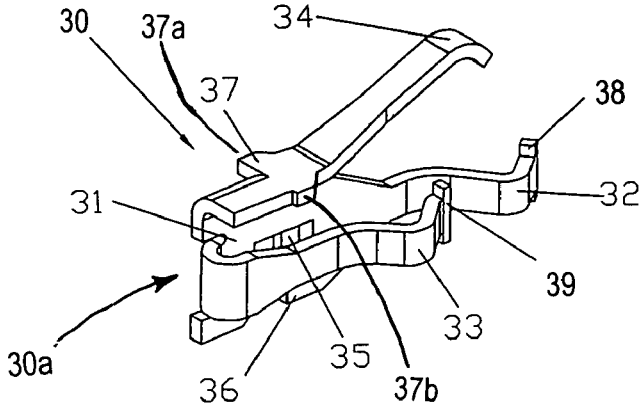
FIG. 9*a* to FIG. 9*d* are a perspective, top, bottom and side views of the second terminal of the present invention.
Figure 9B:
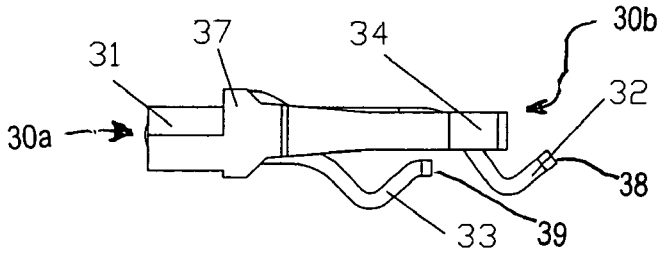
Figure 9C:
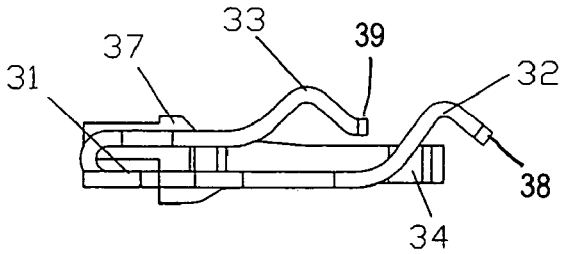
Figure 9D:
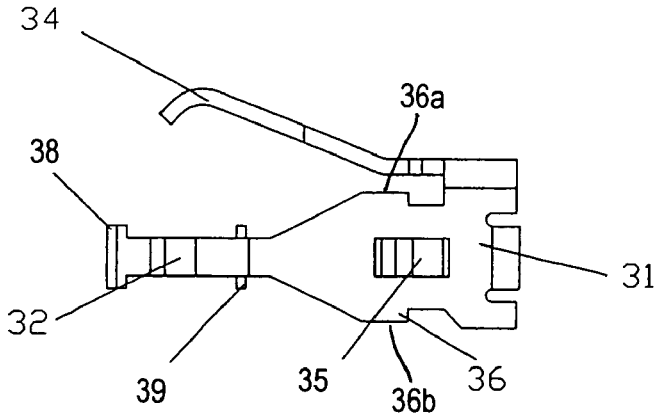
Figure 10:
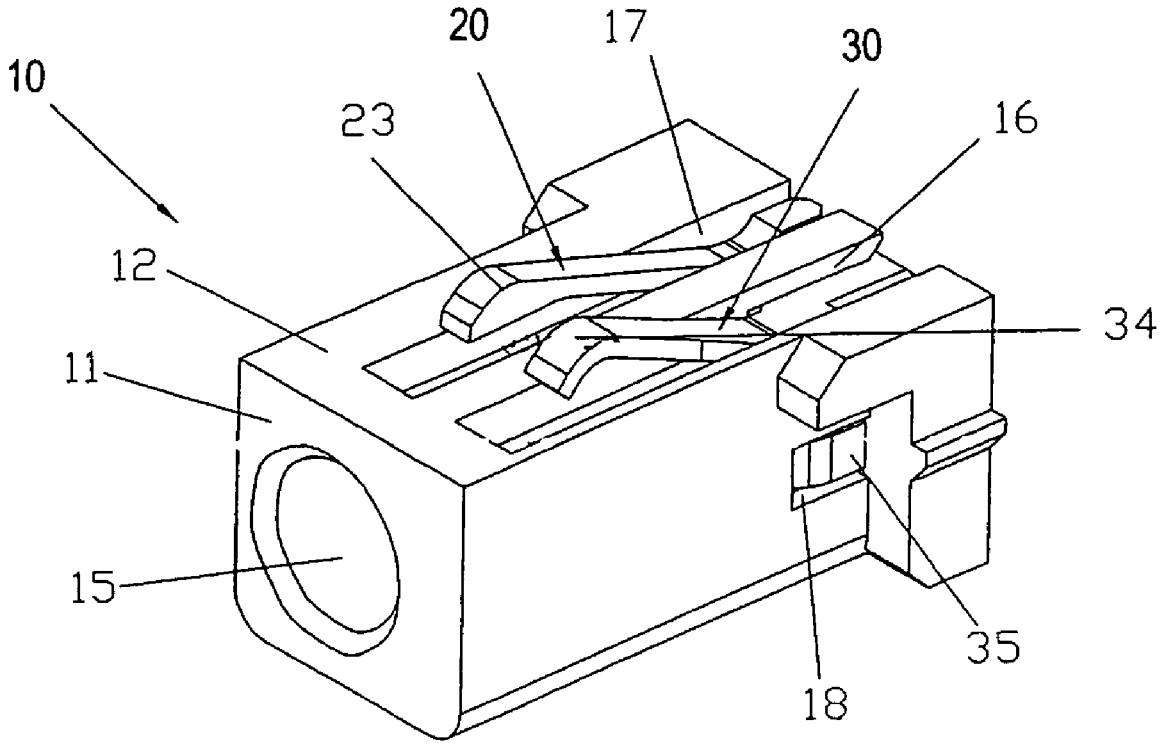
FIG. 10 is a perspective view of the present invention showing the opposite side of the housing that is shown in FIG. 3.

Referring to FIG. 9*d*, the main body 31 of the second terminal 30 has a stamped retaining resilient piece 35. As shown in FIG. 10, this resilient piece 35 is retained in an opening 18 in a corresponding side wall of the dielectric housing 10 which will further help to fix the second terminal 30 in the dielectric housing 30.

The second contacting section 33 of the second terminal 30 is bent 180 degrees from the rear end of the main body 31 until it extends forwardly. This creates a longer arm than available in the prior art arm 66 (FIG. 1). A longer arm will reduce the stress effect which could reduce the force placed on the mating terminal. Because a longer bending arm is used, it will be more tolerant to the stress caused by multiple insertions and withdrawals, and therefore, a less expensive metal can be used. Furthermore, the connecting portion 21, the cylindrical contacting portion 22, and the pressing portion 23 of the first terminal 20 are stamped. This will not only overcome the problems of stress during use but will also improve quality since only a few dimensions can be stamped rather than many dimensions which must be maintained during each step of the bending process to form the cylindrical first connector portion 51 in the prior art.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A power connector mounted in a portable electronic device and matable with a plug connector; comprising:

a dielectric housing having an insertion face and a mounting face and including a first mounting passage and a second mounting passage communicating with each other, the insertion face including an insertion hole and communicating with the first and second mounting passages and the mounting face including slots;

a first terminal, having a contacting portion inserted into the first mounting passage of the dielectric housing;

a second terminal with a rear end and a front end, having a main body, a first contacting section and a second contacting section, wherein, the first contacting section is bent from an end of the main body near the terminal front end and extends toward the terminal front end to define a length of the first contacting section, said length being on a selected side of the main body of the second terminal, with the main body, the first contacting section and the second contacting section being inserted into the second mounting passage of the dielectric housing;

the second contacting section of the second terminal being formed by being bent from the terminal rear end of the main body thereof and extending toward the terminal front end to define a length of the second contacting section, said length of the second contacting section also being on said selected side of the main body of the second terminal; and said length of the first contacting section extends toward the terminal front beyond the length of the second contacting section.

2. The power connector as claimed in claim 1, wherein a base portion of the contacting portion of the first terminal forms a retaining portion.

3. The power connector as claimed in claim 1, wherein the main body of the second terminal is punched and stamped and formed with a retaining resilient piece, and an opening is defined in a corresponding side wall of the dielectric housing, the retaining resilient piece latchable within the opening.

4. The power connector as claimed in claim 1, wherein free ends of the first contacting section and the second contacting section of the second terminal form stops extending laterally from an edge of each terminal which slides behind a wall of the second mounting passage of the dielectric housing.

5. The power connector as claimed in claim 1, wherein the first terminal has a connecting portion, a contacting portion in a cylindrical shape, and a pressing portion, the cylindrical contacting portion inserted into the first mounting passage of the dielectric housing.

6. The power connector as claimed in claim 5, wherein the pressing portion of the first terminal extends from the connecting portion above the contacting portion, and is formed at a free end thereof.

7. A power connector mounted in a portable electronic device and matable with a plug connector; comprising: a dielectric housing having an insertion face and a mounting face and including a first mounting passage and a second mounting passage communicating with each other, the insertion face including an insertion hole and communicating with the first and second mounting passages and the mounting face including slots; a first terminal, having a contacting portion inserted into the first mounting passage of the dielectric housing; a second terminal with a rear end and a front end, having a main body, a first contacting section and a second contacting section, wherein, the first contacting section is bent from an end of the main body near the terminal front end and extends toward the terminal front end, with the main body, the first contacting section and the second contacting section being inserted into the second mounting passage of the dielectric housing; the second contacting section of the second terminal being formed by being bent from the terminal rear end of the main body thereof and extending toward the terminal front end, wherein the second terminal includes a pressing section, and the pressing section of the second terminal extends from a side edge of the main body, near the terminal rear end, above the first and second contacting portions, and is cantilevered.

8. The power connector as claimed in claim 7, wherein a base portion of the contacting portion of the first terminal forms a retaining portion.

9. The power connector as claimed in claim 7, wherein the main body of the second terminal is punched and stamped and formed with a retaining resilient piece, and an opening is defined in a corresponding side wall of the dielectric housing, the retaining resilient piece latchable within the opening.

10. The power connector as claimed in claim 7, wherein free ends of the first contacting section and the second contacting section of the second terminal form stops extending laterally from an edge of each terminal which slides behind a wall of the second mounting passage of the dielectric housing.

11. The power connector as claimed in claim 7, wherein the first terminal has a connecting portion, a contacting portion in a cylindrical shape, and a pressing portion, the cylindrical contacting portion inserted into the first mounting passage of the dielectric housing.

12. The power connector as claimed in claim 11, wherein the pressing portion of the first terminal extends from the connecting portion above the contacting portion, and is formed at a free end thereof.

13. A power connector mounted in a portable electronic device and matable with a plug connector; comprising: a dielectric housing having an insertion face and a mounting face and including a first mounting passage and a second mounting passage communicating with each other, the insertion face including an insertion hole and communicating with the first and second mounting passages and the mounting face including slots; a first terminal, having a contacting portion inserted into the first mounting passage of the dielectric housing; a second terminal with a rear end and a front end, having a main body, a first contacting section and a second contacting section, wherein, the first contacting section is bent from an end of the main body near the terminal front end and extends toward the terminal front end, with the main body, the first contacting section and the second contacting section being inserted into the second mounting passage of the dielectric housing; the second contacting section of the second terminal being formed by being bent from the terminal rear end of the main body thereof and extending toward the terminal front end, wherein the second terminal includes a pressing section, and a base portion of the pressing section of the second terminal forms a retaining portion.

14. The power connector as claimed in claim 13, wherein a base portion of the contacting portion of the first terminal forms a retaining portion.

15. The power connector as claimed in claim 13, wherein the main body of the second terminal is punched and stamped and formed with a retaining resilient piece, and an opening is defined in a corresponding side wall of the dielectric housing, the retaining resilient piece latchable within the opening.

16. The power connector as claimed in claim 13, wherein free ends of the first contacting section and the second contacting section of the second terminal form stops extending laterally from an edge of each terminal which slides behind a wall of the second mounting passage of the dielectric housing.

17. The power connector as claimed in claim 13, wherein the first terminal has a connecting portion, a contacting portion in a cylindrical shape, and a pressing portion, the cylindrical contacting portion inserted into the first mounting passage of the dielectric housing.

18. The power connector as claimed in claim 17, wherein the pressing portion of the first terminal extends from the connecting portion above the contacting portion, and is formed at a free end thereof.

* * * * *